US006601876B1

(12) United States Patent
Instance

(10) Patent No.: US 6,601,876 B1
(45) Date of Patent: Aug. 5, 2003

(54) LABELS AND LABELLED PACKAGES

(75) Inventor: David John Instance, Ashford (GB)

(73) Assignee: David J. Instance, Ltd., Kent (GB)

( * ) Notice: Subject to any disclaimer, the term of this patent is extended or adjusted under 35 U.S.C. 154(b) by 0 days.

(21) Appl. No.: 09/959,421

(22) PCT Filed: Apr. 27, 2000

(86) PCT No.: PCT/GB00/01628

§ 371 (c)(1),
(2), (4) Date: Jan. 28, 2002

(87) PCT Pub. No.: WO00/64780

PCT Pub. Date: Nov. 2, 2000

(30) Foreign Application Priority Data

Apr. 27, 1999 (GB) ..... 9909685

(51) Int. Cl.[7] ..... B42D 15/00

(52) U.S. Cl. ..... 283/81; 283/101; 283/105; 283/106; 283/56; 40/638; 428/43

(58) Field of Search ..... 283/72, 74, 75, 283/79, 80, 81, 101, 105, 56, 903, 106, 61, 62; 428/40.1, 41.7, 41.8, 41.9, 42.1, 94, 914, 43; 40/310, 638, 299, 312

(56) References Cited

U.S. PATENT DOCUMENTS

| | | | | | |
|---|---|---|---|---|---|
| 4,717,176 A | * | 1/1988 | Matthews | ..... | 281/31 |
| 4,977,003 A | * | 12/1990 | Brown et al. | ..... | 428/35.5 |
| 5,738,382 A | * | 4/1998 | Grosskopf | ..... | 283/81 |

FOREIGN PATENT DOCUMENTS

| | | | | | |
|---|---|---|---|---|---|
| DE | 4429503 A1 | | 2/1996 | | |
| EP | 0 686 563 A2 A3 | | 12/1995 | | |
| EP | 1094430 | * | 10/2000 | ..... | 283/81 |
| FR | 2.227.190 | | 11/1974 | | |
| GB | 2 240 082 A | | 7/1991 | | |
| GB | 2 303 351 A | | 2/1997 | | |

* cited by examiner

*Primary Examiner*—Willmon Fridie, Jr.
(74) *Attorney, Agent, or Firm*—Rothwell, Figg, Ernst & Manbeck, p.c.

(57) ABSTRACT

Labels for blister packs, and to blister packs provided with such a label. A label for a blister pack comprising a support piece having a rear self-adhesive surface and at least one removable portion bounded by at least one tear line on a front surface of the support piece; and a multilaminar portion held on the front surface of the support piece.

24 Claims, 5 Drawing Sheets

LABELS AND LABELLED PACKAGES

Figure 1A:
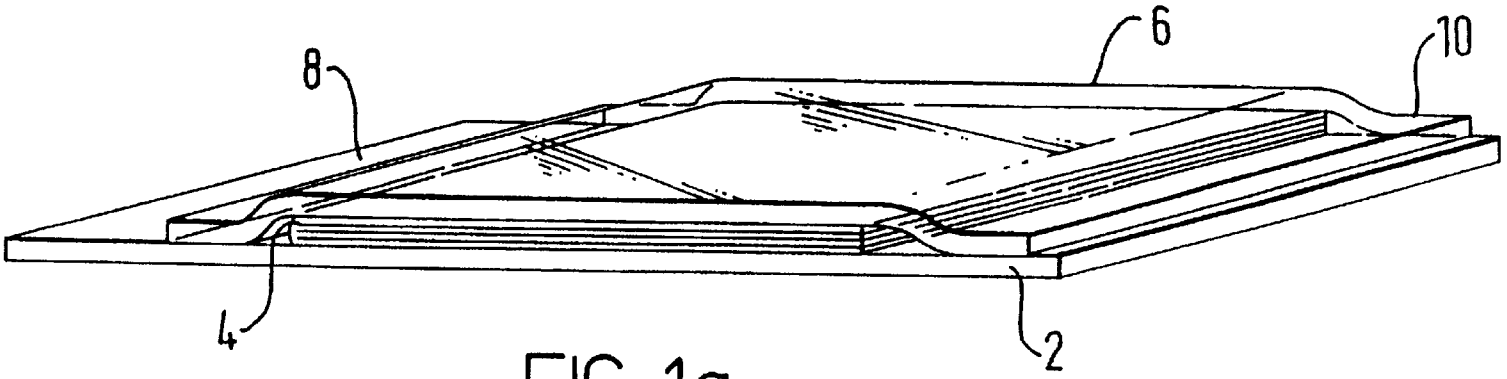

The present invention relates to labels for blister packs, and to blister packs provided with such a label.

Blister packs are typically used for seal-packaging a plurality of pharmaceutical tablets, wherein each tablet can be dispensed individually whilst leaving the remaining tablets in a sealed condition. A typical blister pack contains a moulded plastic receptacle comprising an ordered array of distinct pockets or "blisters". A single pharmaceutical tablet is arranged in each pocket, and the opening of each pocket is covered by a sealing layer, typically a thin metal foil, to thereby seal each tablet in its respective pocket. A tablet is dispensed by piercing the sealing layer at the opening of the respective pocket. The remaining tablets remain in a sealed state, since the sealing layer is adhered to the moulded plastic receptacle in such a manner that the piercing of the sealing layer in the region of one pocket does not break the seal of the remaining sealed pockets.

This type of package has the drawback however that the sealing layer, typically being a thin layer of thin metal foil, can be pierced very easily making the contents of the package easily accessible even to a small child. These types of packages are therefore inherently not very child proof. Furthermore, the written instructions and information provided with conventional blister packs are provided separately from the blister pack itself, the two being typically enslosed in a cardboard packet. Since the instructions are provided detached from the blister pack itself, there is the danger that the written instructions will become lost leaving the user in the undesirable situation of being left with pharmaceutical tablets about which he has no information ready at hand.

It is an aim of the present invention to provide a label for a blister pack, the application of which to the blister improves the safety of the blister pack with respect to its childproofness, and which preferably also solves the problem of the associated written instructions becoming lost.

It is a further aim of the present invention to provide a labelled blister pack which is inherently safer with respect to its childproofness, and which preferably solves the problem of the associated written instructions becoming lost.

According to a first aspect of the present invention, there is provided a label for a blister pack comprising: a support piece having a rear self-adhesive surface and at least one removeable portion bounded by at least one tear line on a front surface of the support piece; and a multilaminar portion held on the front surface of the support piece.

According to a second aspect of the present invention, there is provided a labelled package comprising: a receptacle comprising at least one pocket into which a respective object is stored and having an opening via which the object ray be dispensed; a sealing layer which covers the opening to seal the pocket; a label support piece having a rear surface adhered to the seal layer and at least one removable portion covering the opening of the pocket and bounded by at least one tear line on the front surface of the support piece; and a multilaminar portion held on the front surface of the label support piece.

According to a third aspect of the present invention there is provided a self-adhesive label for a blister pack carried on a backing of release material comprising: a support piece having a rear self-adhesive surface adhered to the backing of release material and a front surface, the support piece comprising a plurality of removeable portions each bounded by a tear line; and a multilaminar portion held on the front surface of the support piece.

According to a preferred embodiment, the multilaminar portion is releaseably held on the support piece, preferably by the provision of an overlaminate which is arranged on the multilaminar portion and has two opposed edge portions adhered to the front surface of the support piece, at least one of which is releasably adhered to the front surface of the support piece.

However, the provision of such an overlaminate is not an essential feature; the multilaminar portion could, for example, be held on by a thin layer, line or dots of adhesive between the multilaminar portion and the support piece, the nature of such adhesion being such that the multilaminar portion can be peeled by hand away from the support piece by a user at least to the extent that access can be gained to all of the removable portions.

Embodiments of the present invention will be described hereunder, by way of example only, with reference to the accompanying drawings, in which:

FIG. 1*a* is a perspective view of a label according to a first embodiment of the present invention.

Figure 1B:
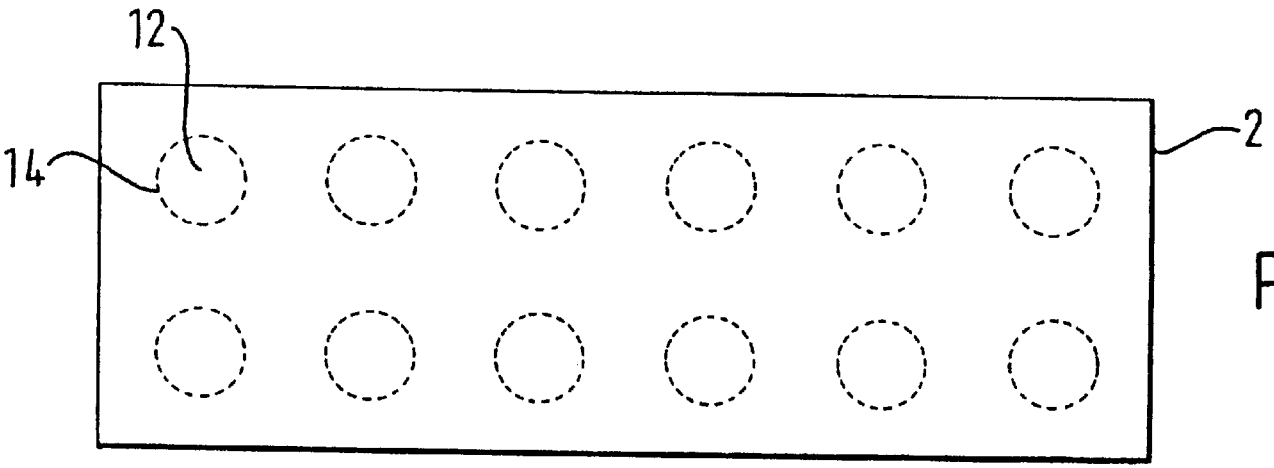

FIG. 1*b* is a plan view of the support piece employed in the label shown in FIG. 1*a*.

Figure 1C:
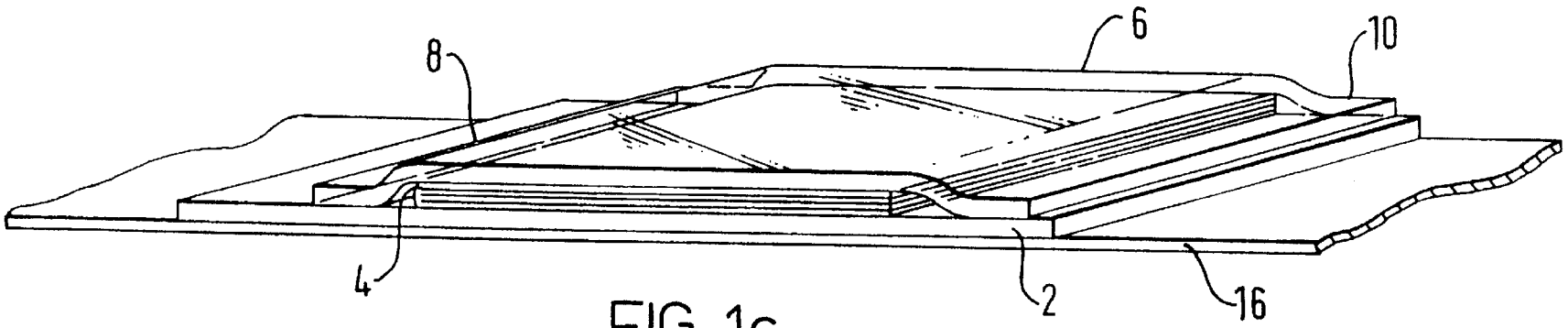

FIG. 1*c* is a perspective view of the label shown in FIG. 1*a* carried on a backing of release material.

Figure 2A:
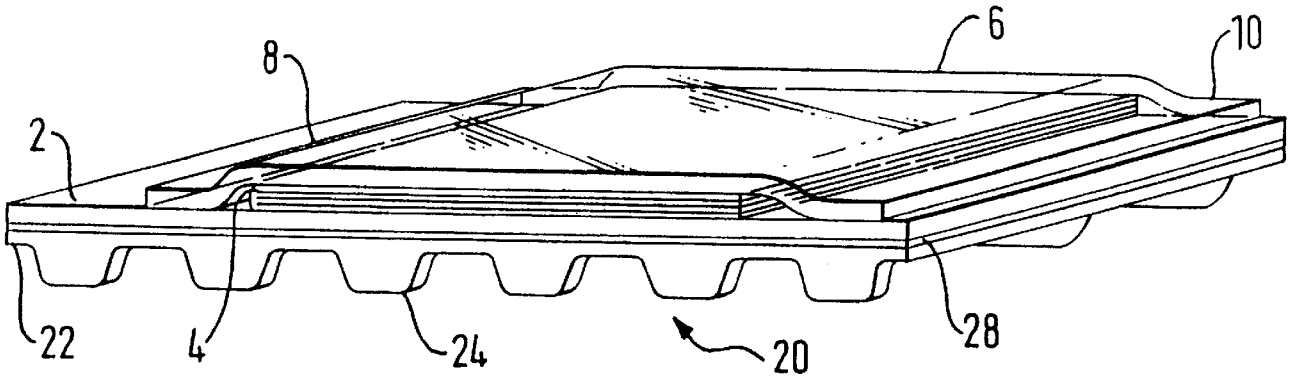

FIG. 2*a* is a perspective view of the label shown in FIG. 1 applied to a blister pack.

Figure 2B:
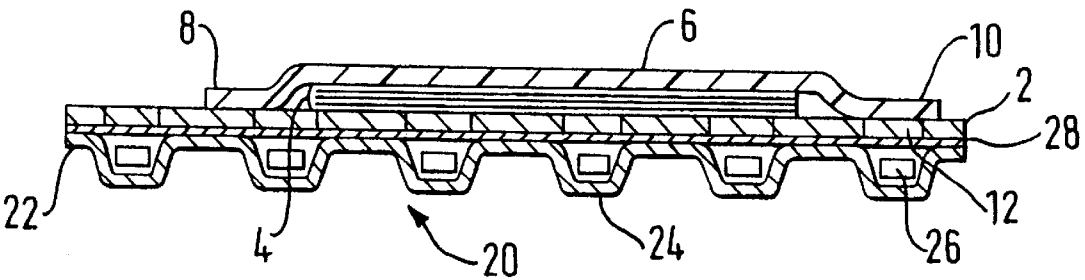

FIG. 2*b* is a cross-sectional view of the labelled blister pack shown in FIG. 2*a*.

Figure 3A:
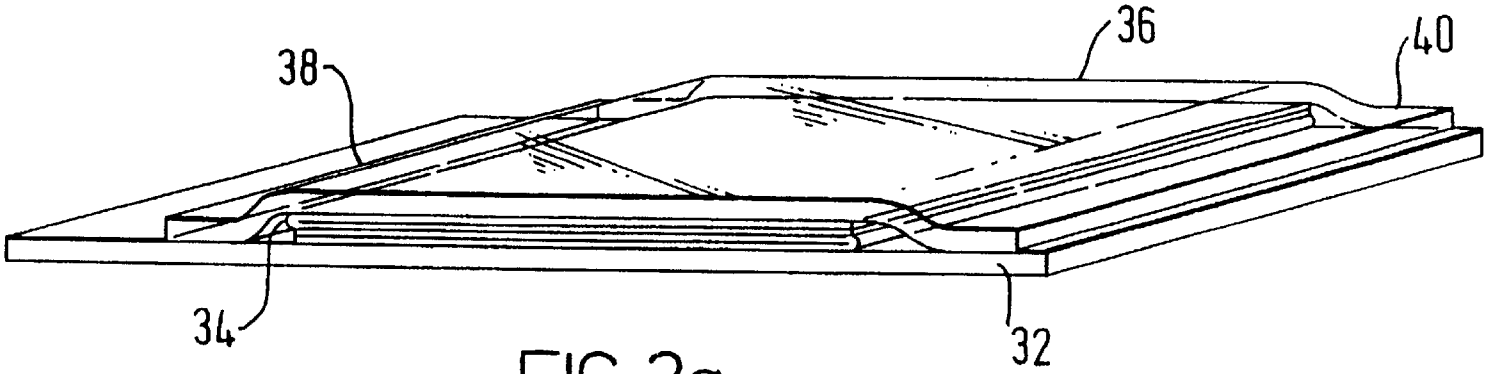

FIG. 3*a* is a perspective view of a label according to a second embodiment of the present invention.

Figure 3B:
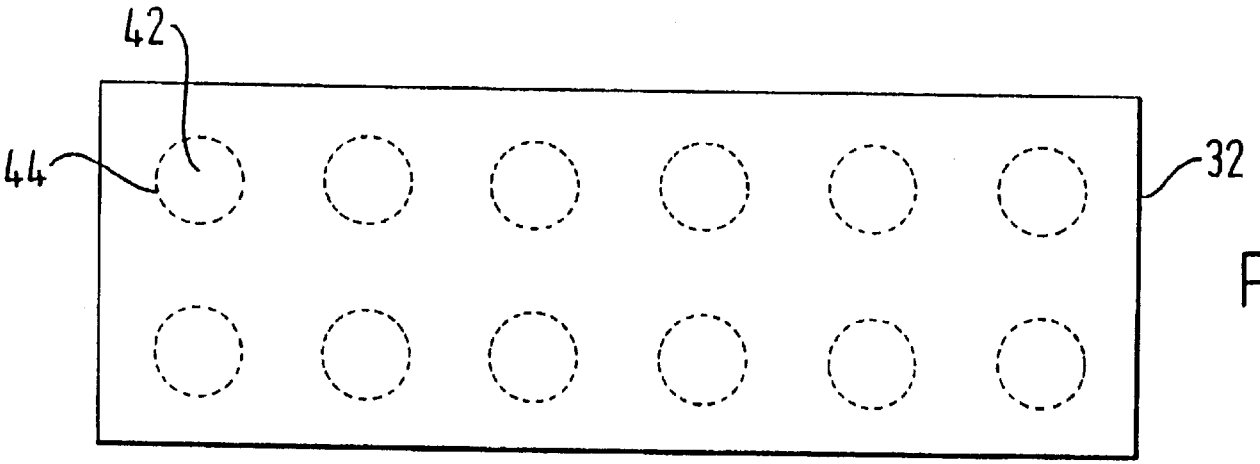

FIG. 3*b* is a plan view of the support piece employed in the label shown in FIG. 3*a*.

Figure 4A:
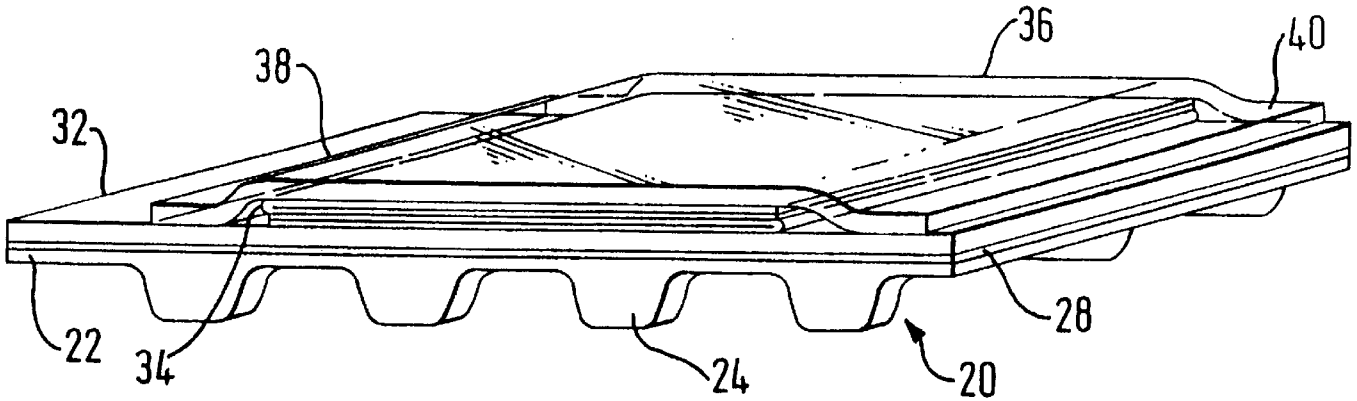

FIG. 4*a* is a perspective view of the label shown in FIG. 3*a* applied to a blister pack.

Figure 4B:
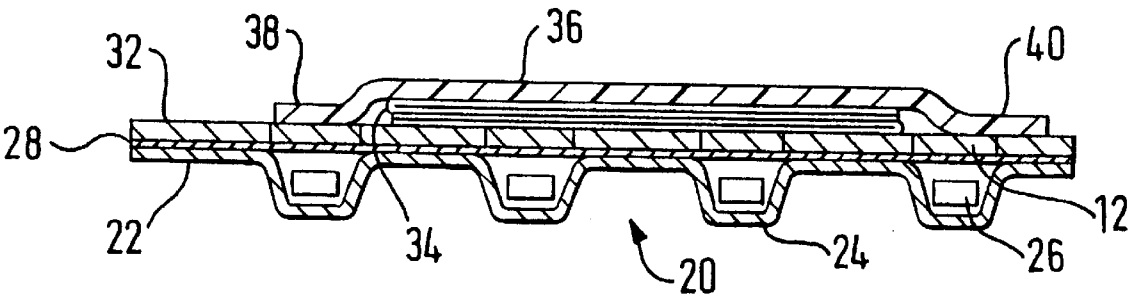

FIG. 4*b* is a cross-sectional view of the labelled blister pack shown in FIG. 4*a*.

With reference to FIG. 1*a*, the label according to a first embodiment of the present invention comprises a support piece 2, which is typically made out of paper, a multi-page booklet 4 arranged on the support piece 2, and a transparent plastics overlaminate 6 arranged on the multi-page booklet 4 and having opposed lateral edge portions 8, 10 adhered to the support piece whereby the multi-page booklet 4 is maintained in a closed configuration.

As shown in FIG. 1*a*, the support piece 2 comprises an ordered array of removable portions 12 each bounded by a series of perforations 14. In, alternative embodiments, the series of perforations 14 may be replaced by a continous line of weakening or even a printed line defining the removable portions. The actual positioning and spacing of these removable portions will depend on the positioning and spacing of the pockets of the blister pack to which the label is to be applied. The perforations are configured and designed such that the respective removable portion can be removed from the remainder of the support piece by pressing on the respective removable portion with a finger or thumb.

In the embodiment shown in FIG. 1*a*, the overlaminate 6 is a transparent plastic overlaminate having a rear self-adhesive surface. The overlaminate 6 thus becomes permanently adhered (in the sense that it is not intended to be removed therefrom) to the front surface of the cover sheet of the multi-page booklet 4. The use of transparent plastic overlaminate 6 has the advantage that the front surface of the cover sheet of the multi-page booklet 4 can also be printed with information.

In this embodiment, both of the opposed lateral edge portions 8, 10 of the plastic overlaminate 6 are releaseably adhered to the support piece 2. The front surface of the support piece 2 is modified (at least in the areas thereof to which the overlaminate 6 is adhered) such that the nature of the adhesion between the support piece 2 and the rear self-adhesive surface of the overlaninate 6 is such that the entire overlaminate 6 and multi-page booklet 4 can be released from the support piece as a single unit whereby the user can gain access to the removable portions 12 of the support piece 2 and to the information printed in the multi-page booklet 4, and can be subsequently readhered to the support piece.

Although not shown in the figures, a corner of each of the opposed edge portions 8, 10 of the overlaminate 6 may be modified such that it is rendered non-adhesive with respect to the front surface or the support piece. This has the advantage that the opposed edge portions 8, 10 of the overlaminate are further readily peelable from the front surface of the support piece thereby further facilitating opening of the label. This can be achieved, for example, by applying ink or by applying a piece of paper to the respective corner. In the case of the application of a piece of paper, the piece of paper may be an integral part of the booklet 4 in the form of a tab protruding from the top sheet of the booklet 4.

In an alternative construction, one of the opposed edges 8, 10 of the self-adhesive transparent plastic overlaminate can be permanently adhered to the support piece, and the other of the opposed edges 8, 10 is releaseably adhered to the support piece 2. This construction has the advantage that the multi-page booklet 4 never becomes detached from the support piece 2. This has the advantage that the problem of the written instructions becoming lost is overcome. In such an alternative construction, the multi-page booklet 4 and overlaminate 6 would have to be arranged on the support piece 2 such that the portion of the overlaminate 6 which is permanently adhered to the support piece 2 does not cover any of the removable portions.

In the embodiment shown in FIG. 1, the multi-page booklet is only adhered to the rear self-adhesive surface of the overlaminate 6. However, it may alternatively or additionally be temporarily lightly adhered to the front surface of the support piece 2 by the application of a thin layer, line or dots of adhesive between the undersurface of the multi-page booklet 4 and the support piece 4. The nature of the adhesion is such that the booklet can easily be pulled away from the support piece when the label is opened by peeling one or more of the opposed edges of the overlaminate from the support piece. Temporarily adhering the booklet to the support piece has the advantage that it facilitates manufacture of the label since it avoids the problem of the booklet becoming misaligned or in the worst case completely detached from the support piece before the self-adhesive overlaminate is applied which securely holds the booklet in place on the support piece.

According to a further alternative construction, the multi-page booklet is neither adhered to the support piece nor to the overlaminate, and is only held in place on the label by the sandwiching effect of the overlaminate and the support piece.

FIGS. 2*a* and 2*b* show the label shown in FIG. 1*a* applied to a blister pack 20. The blister pack comprises a moulded plastic receptacle 22 comprising an ordered array of pockets 24 or "blisters" into each of which is arranged a single tablet 26. A thin metal foil 28 is applied to the moulded plastic receptacle 22 such that it is permanently adhered to the portions of the upper surface of the moulded plastic article surrounding each opening to each pocket 24. The rear surface of the support piece 2 is then permanently adhered to the upper surface of the thin metal foil 28 such that the removable portions 12 of the support piece 2 line up with the openings to the pockets 24 of the blister pack 20. Each of the removable portions can be printed with a warning message.

In order to facilitate the application of the label to the blister pack 20, the support piece 2 is provided with a rear self-adhesive surface. The label is produced on a backing of release material 16 as shown in FIG. 1*c*. The whole label is then easily peeled off the backing of release material 16 for application to a blister pack.

A tablet can be dispensed from the labelled blister pack in the following manner. The label is first opened by releasing one or both opposed edge portions 8, 10 of the overlaminate 6 from the support piece 2 and lifting the overlaminate 6 and multi-page booklet 4 to provide access to a removable portion 12 of the support piece 2 covering the opening of a pocket 24. A tablet can then be dispensed by applying pressure to the respective removable portion 12 to break the line of perforations 14 and at the same time pierce the underlying sealing layer 28 covering the opening of the respective pocket 24 to provide access to the tablet contained in the respective pocket 24. After the tablet has been removed from the pocket 24, the label can be closed again by readhering the lateral edge portion or portions 8, 10 of the overlaminate 6 which were released from the support piece 2 in order to open the label.

The force required to break through both the support piece and the underlying sealing layer is greater than the force required to break through the sealing layer alone, thereby making it harder for small children to access the tablets in the blister pack. Moreover, the presence of the booklet 4 over the overlaminate 6 provides an additional level of security against inadvertent or child access to the pockets 24.

The label according to a second embodiment of the present invention shown in FIG. 3 is identical to that shown in FIG. 1 and described above except that it comprises a folded leaflet 34 instead of a multi-page booklet and that one of the opposed edge portions 38 is permanently adhered to support piece 32. This can be achieved for example by only modifying the portion of the front surface of the support piece 32 to which the lateral edge 40 of the overlaminate is to be adhered. The features, advantages and alternative constructions described for the label according to the first embodiment of the present invention are equally applicable to this label according to the second embodiment, and a repetition of the description thereof is omitted here for the sake of conciseness.

As shown In FIGS. 4*a* and 4*b*, the folded leaflet 34 and overlaminate are positioned such that the lateral edge 38 of the overlaminate which is permanently adhered to the support piece does not cover any of the removable portions 42 each bounded by a series of perforations 44. This ensures that access can be gained to all of the pockets of the blister pack. The blister pack itself is identical in construction to that shown in FIGS. 2*a* and 2*b*, and identical reference numerals are used to indicate identical components.

What is claimed is:

1. A label for a blister pack comprising:

a support piece having a rear self-adhesive surface; and a multilaminar portion held on a front surface of the support piece;

wherein the support piece includes at least one removable portion underlying the multilaminar portion and bounded by at least one tear line on the front surface of the support piece.

2. A label for a blister pack according to claim 1 further comprising:

an overlaminate arranged over the multilaminar portion and having two opposed edge portions adhered to the front surface of the support piece, at least one of the opposed edge portions being releaseably adhered to the front surface of the support piece.

3. A label according to claim 2 wherein the multilaminar portion is adhered to the overlaminate.

4. A label according to claim 2, wherein one the opposed edge portions of the overlaminate is permanently adhered to the front surface of the support piece.

5. A label according to claim 2, wherein both of the opposed edge portions which are adhered to the support piece are releaseably adhered to the support piece.

6. A label according to claim 1, wherein the multilaminar portion comprises one of a folded leaflet and a booklet.

7. A label according to claim 1, wherein the support piece comprises a plurality of removable portions each bounded by a tear line.

8. A label according to claim 7 wherein the plurality of removable portions comprises an ordered array of removable portions.

9. A label according to claim 1, wherein each removable portion of the support piece is printed with a warning message.

10. A label according to claim 1, wherein the tear line conprises a series of perforations.

11. A labelled package comprising:

a receptacle comprising at least one pocket into which a respective object is stored and having an opening via which the object may be dispensed;

a sealing layer which covers the opening to seal the pocket;

a label support piece having a rear surface adhered to the seal layer and at least one removable portion covering the opening of the pocket and bounded by at least one tear line on the front surface of the support piece; and a multilaminar portion held on the front surface of the label support piece.

12. A labelled package according to claim 11 further comprising an overlaminate arranged over the multilaminar portion and having two opposed edge portions adhered to the front surface of the label support piece, at least one of the opposed edge portions being adhered releaseably to the front surface of the label support piece.

13. A labelled package according to claim 12 wherein the multilaminar portion is adhered to the overlaminate.

14. A labelled package according to claim 12, wherein one of the opposed edge portions of the overlaminate is permanently adhered to the front surface of the support piece.

15. A labelled package according to claim 12, wherein both of the opposed edge portions of the overlaminate are releaseably adhered to the front surface of the support piece.

16. A labelled package according to claim 11, wherein the receptacle comprises a plurality of pockets each having an opening covered by a seal layer to effect sealing thereof; and the label support piece comprises a plurality of removable portions corresponding to the plurality of openings, each removable portion being bounded by a tear line.

17. A labelled package according to claim 16 wherein each of the plurality of pockets is sealed by a single sealing layer.

18. A labelled package according to claim 11, to wherein the multilaminar portion is one of a folded leaflet and a booklet.

19. A labelled package according to claim 11, wherein each removable portion of the label support piece is printed with a warning message.

20. A labelled package according to claim 11, to wherein the tear line comprises a series of perforations.

21. A self-adhesive label for a blister pack carried on a backing of release material comprising:

a support piece having a rear self-adhesive surface adhered to the backing of release material and a front surface, the support piece comprising a plurality of removable portions each bounded by a tear line; and a multilaminar portion held on the front surface of the support piece.

22. A self-adhesive label carried on a backing of release material according to claim 21 further comprising an overlaminate arranged over the multilaminar portion and having opposed edge portions adhered to the front surface of the support piece, at least one of the opposed edges being releaseably adhered to the front surface of the support piece.

23. A self-adhesive label substantially as hereinbefore described with reference to any of FIGS. 1*a* to 1*c*, FIGS. 2*a* and 2*b*, FIGS. 3*a* and 3*b* or FIGS. 4*a* and 4*b*.

24. A labelled package substantially as hereinbefore described with reference to any of FIGS. 2*a* to 2*b* or FIGS. 4*a* to 4*b*.

* * * * *